US011276923B2

(12) United States Patent
Chen et al.

(10) Patent No.: US 11,276,923 B2
(45) Date of Patent: Mar. 15, 2022

(54) MULTI-BAND ANTENNA ARRANGEMENT

(71) Applicant: NOKIA SOLUTIONS AND NETWORKS OY, Espoo (FI)

(72) Inventors: Jiangcheng Chen, Oulu (FI); Markus Berg, Kiiminki (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 127 days.

(21) Appl. No.: 16/863,634

(22) Filed: Apr. 30, 2020

(65) Prior Publication Data

US 2020/0350672 A1 Nov. 5, 2020

(30) Foreign Application Priority Data

May 2, 2019 (EP) ..... 19172157

(51) Int. Cl.

| | |
|---|---|
| ***H01Q 1/52*** | (2006.01) |
| ***H01Q 5/10*** | (2015.01) |
| ***H01Q 1/24*** | (2006.01) |
| ***H01Q 9/28*** | (2006.01) |

(52) U.S. Cl.

CPC ..... *H01Q 1/52* (2013.01); *H01Q 1/243* (2013.01); *H01Q 1/246* (2013.01); *H01Q 5/10* (2015.01); *H01Q 9/285* (2013.01)

(58) Field of Classification Search

CPC ..... H01Q 1/38; H01Q 1/52; H01Q 1/243; H01Q 1/246; H01Q 5/345; H01Q 9/0442; H01Q 9/284; H01Q 5/10; H01Q 13/106

See application file for complete search history.

(56) References Cited

U.S. PATENT DOCUMENTS

| | | | | |
|---|---|---|---|---|
| 7,061,442 | B1 | 6/2006 | Tang et al. | |
| 2014/0028529 | A1 | 1/2014 | Waidmann et al. | |
| 2014/0062818 | A1* | 3/2014 | Tsai | H01Q 5/335 343/746 |
| 2019/0221940 | A1* | 7/2019 | Pance | H01Q 19/18 |

(Continued)

FOREIGN PATENT DOCUMENTS

| | | | |
|---|---|---|---|
| CN | 1841846 | A | 10/2006 |
| CN | 203690491 | U | 7/2014 |
| CN | 203690501 | U | 7/2014 |

(Continued)

OTHER PUBLICATIONS

Abde-Rahman et al., "Design of UWB Printed Monopole Antenna with Dual Band Notch Filter", IEEE Middle East Conference on Antennas and Propagation (MECAP 2010), (Oct. 20-22, 2010), 5 pages.

(Continued)

*Primary Examiner* — Thanh C Le
(74) *Attorney, Agent, or Firm* — Alston & Bird LLP

(57) ABSTRACT

A multi-layer antenna arrangement is provided that includes a first layer having a conductive radiating element configured to have multiple overlapping resonant modes that define a first frequency range. The multi-layer antenna arrangement also includes a second layer having at least a portion of a ground plane for the conductive radiating element. The multi-layer antenna arrangement additionally includes a third layer, between the first layer and the second layer, that has a conductive resonator configured to provide a stop band within the first frequency range.

16 Claims, 6 Drawing Sheets

(56) References Cited

U.S. PATENT DOCUMENTS

| | | | | |
|---|---|---|---|---|
| 2019/0237878 | A1* | 8/2019 | Seetharamdoo | G06F 30/20 |
| 2021/0175610 | A1* | 6/2021 | Ramasamy | H01Q 9/42 |

FOREIGN PATENT DOCUMENTS

| | | | |
|---|---|---|---|
| CN | 104488137 | A | 4/2015 |
| CN | 105914456 | A | 8/2016 |
| CN | 106252872 | A | 12/2016 |
| CN | 107171078 | A | 9/2017 |
| CN | 207677078 | U | 7/2018 |
| CN | 108767459 | A | 11/2018 |
| CN | 109473769 | A | 3/2019 |
| CN | 111883928 | A | 11/2020 |
| EP | 2963736 | A1 | 1/2016 |
| KR | 20050080205 | A | 8/2005 |
| WO | WO 2010/029305 | A1 | 3/2010 |
| WO | WO 2016/097712 | A1 | 6/2016 |

OTHER PUBLICATIONS

Extended European Search Report for European Application No. 19172157.0 dated Nov. 26, 2019, 9 pages.

Huang et al., "A Novel Frequency Selective Surface for Ultra Wideband Antenna Performance Improvement", 2013 Proceedings of the International Symposium on Antennas & Propagation, (Oct. 23-25, 2013), 4 pages.

Office Action for Chinese Application No. 202010371281.7 dated Feb. 3, 2021, 17 pages.

He, K. et al., *A Wideband Dual-Band Magneto-Electric Dipole Antenna With Improved Feeding Structure*, IEEE Antennas and Wireless Propagation Letters, vol. 13 (2014) 1729-1732.

Feng, B. et al., *Dual-Wideband Complementary Antenna With a Dual-Layer Cross-ME-Dipole Structure for 2G/3G/LTE/WLAN Applications*, IEEE Antennas and Wireless Propagation Letters, vol. 14 (2015) 626-629.

Huang, H. et al., *A Dual-Broadband, Dual-Polarized Base Station Antenna for 2G/3G/4G Applications*, IEEE Antennas and Wireless Propagation Letters, vol. 16 (2017) 1111-1114.

Huang, H. et al., *Uniplanar Differentially Driven Ultrawideband Polarization Diversity Antenna With Band-Notched Characteristics*, IEEE Antennas and Wireless Propagation Letters, vol. 14 (2015) 563-566.

Jiang, J.-B. et al., *A Novel Compact UWB Notch-Filter Antenna With a Dual-Y-Shaped Slot*, Progress in Electromagnetics Research Letters, vol. 14 (2010) 165-170.

Kumar, R. et al., *A Horizontally Polarized Rectangular Stepped Slot Antenna for Ultra Wide Bandwidth With Boresight Radiation Patterns*, IEEE Transactions on Antennas and Propagation, vol. 62, No. 7 (Jul. 2014) 3501-3510.

Li, M. et al., *A Miniaturized Dual-Band Base Station Array Antenna Using Band Notch Dipole Antenna Elements and AMC Reflectors*, IEEE Transactions on Antennas and Propagation, vol. 55, No. 5 (Jun. 2018) 3189-3194.

Li, W. T. et al., *Planar Antenna for 3G/Bluetooth/WiMAX and UWB Applications With Dual Band-Notched Characteristics*, IEEE Antennas and Wireless Propagation Letters, vol. 11 (2012) 61-64.

Lian, R. et al., *Design of a Low-Profile Dual-Polarized Stepped Slot Antenna Array for Base Station*, IEEE Antennas and Wireless Propagation Letters, vol. 15 (2016) 362-365.

Liu, Y.-Y. et al., *Compact Differential Band-Notched Stepped-Slot UW-MIMO Antenna With Common-Mode Suppression*, IEEE Antennas and Wireless Propagation Letters, vol. 16 (2017) 593-596.

Majid, H. A. et al., *Wideband Antenna With Reconflgurable Band Notched Using EBG Structure*, Progress in Electromagnetics Research Letters, vol. 54 (2015) 7-13.

Pozar, D. M., *Microwave And RF Design Of Wireless Systems*, John Wiley & Sons, Inc. (2001), 379 pages.

Saxena, A. et al., *Compact Single Wide Band-Notched Slot Antenna Using T-Stub With Large Bandwidth*, International Journal of Advances in Microwave Techniques (IJAMT), vol. 1, No. 2 (Aug. 2016) 58-63.

Sung, Y., *Triple Band-Notched UWB Planar Monopole Antenna Using a Modi fled H-Shaped Resonator*, IEEE Transactions on Antennas and Propagation, vol. 61, No. 2 (Feb. 2013) 953-957.

Weng, Y. F. et al., *Design of Multiple Band-Notch Using Meander Lines for Compact Ultra-Wide Band Antennas*, IET Microwaves, Antennas & Propagation, vol. 6, Issue 8 (2012) 908-914.

Zhang, Y. et al., *Dual-Band Base Station Array Using Filtering Antenna Elements for Mutual Coupling Suppression*, IEEE Transactions on Antennas and Propagation, vol. 64, No. 8 (Aug. 2016) 3423-3430.

* cited by examiner

MULTI-BAND ANTENNA ARRANGEMENT

CROSS-REFERENCE TO RELATED APPLICATIONS

This application claims priority to European Application No. 19172157.0, filed May 2, 2019, the entire contents of which are incorporated herein by reference.

TECHNOLOGICAL FIELD

Embodiments of the present invention relate to a multi-band antenna arrangement. Some embodiments of the present disclosure relate to a multi-band antenna arrangement suitable for use in 5G telecommunications.

BACKGROUND

Telecommunication standards specify operational frequency bands. It is therefore desirable for a transceiver to be multi-band and operate in multiple different operational frequency bands.

While, in some examples, it may be possible to use an antenna arrangement that has a single wide operational bandwidth that covers simultaneously multiple different operational frequency bands, this can be undesirable as there can then be insufficient isolation between communications in the different operational frequency bands causing interference.

BRIEF SUMMARY

According to various, but not necessarily all, embodiments there is provided multi-layer antenna arrangement comprising: a first layer comprising a conductive radiating element configured to have multiple overlapping resonant modes that define a first frequency range; a second layer comprising at least a portion of a ground plane for the conductive radiating element; and a third layer, between the first layer and the second layer, comprising a conductive resonator configured to provide a stop band within the first frequency range.

In some but not necessarily all examples, the first, second and third layers are integrated as a single component.

In some but not necessarily all examples, the first frequency range is greater than 24 GHz.

In some but not necessarily all examples, the conductive radiating element is a slotted patch antenna.

In some but not necessarily all examples, a fundamental dipole mode of the slotted patch antenna is responsible for a first resonance mode and two slot modes are responsible for a second and a third resonance mode, wherein a length of the conductive radiating element determines the fundamental dipole mode.

In some but not necessarily all examples, the conductive radiating element comprises stepped straight slots, each slot comprising a thinner straight central section and a wider straight peripheral section.

In some but not necessarily all examples, a total length of each slot determines a second one of the multiple resonant modes.

In some but not necessarily all examples, dimensions of the wider straight peripheral portion determine a third one of the multiple resonant modes.

In some but not necessarily all examples, the resonator, in the third layer, is configured to operate as a reflector for stop band frequencies.

In some but not necessarily all examples, the conductive resonator comprises multiple microstrip resonators, placed under respective slots of the conductive radiating element.

In some but not necessarily all examples, the microstrip resonators are curved.

In some but not necessarily all examples, the multi-layer antenna arrangement comprises a symmetrical crossed slot arrangement in the conductive radiating element.

In some but not necessarily all examples, the second layer is a lifted ground plane to enhance the gain in higher frequency bands and the multi-layer antenna arrangement further comprises a fourth layer, below the second layer comprising a main ground plane for the conductive radiating element.

In some but not necessarily all examples, the multi-layer antenna arrangement is directly connected to amplification circuitry without an intervening bandstop filter component.

According to various, but not necessarily all, embodiments there is provided examples as claimed in the appended claims.

BRIEF DESCRIPTION

Some example embodiments will now be described with reference to the accompanying drawings in which.

DETAILED DESCRIPTION

Figure 1:
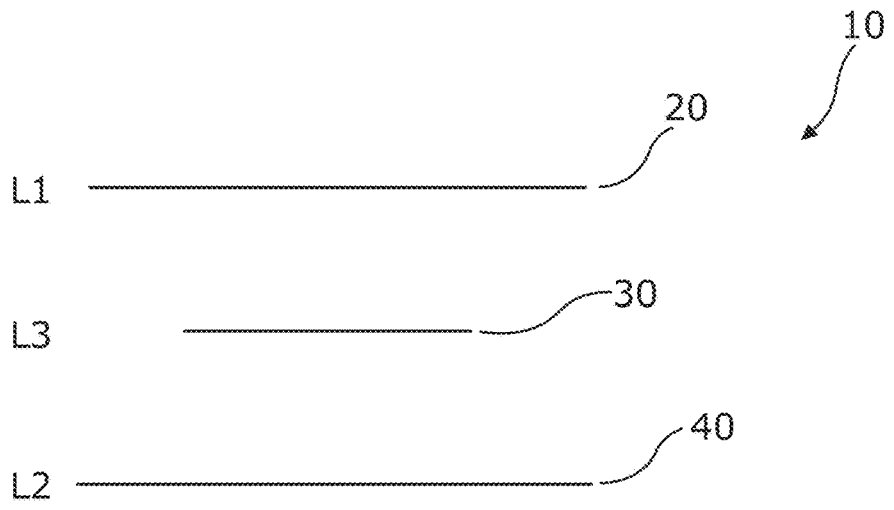
FIG. 1 shows an example of the subject-matter described herein.

FIG. 1 illustrates an example of a multi-layer antenna arrangement 10. As illustrated in FIG. 2C, the multi-layer antenna arrangement 10 is a multi-band antenna that has two isolated resonant modes $\mathbf{72}_1$, $\mathbf{72}_2$. Each resonant mode $\mathbf{72}_1$, $\mathbf{72}_2$ has an associated operational frequency band.

The multi-layer antenna arrangement 10 comprises a first layer L1 comprising a conductive radiating element 20 configured to have multiple overlapping resonant modes 52 that define a first frequency range F; a second layer L2 comprising at least a portion of a ground plane 40 for the conductive radiating element 20; and a third layer L3, between the first layer L2 and the second layer L2, comprising a conductive resonator 30 configured to provide a stop band S within the first frequency range F.

Figure 2A:
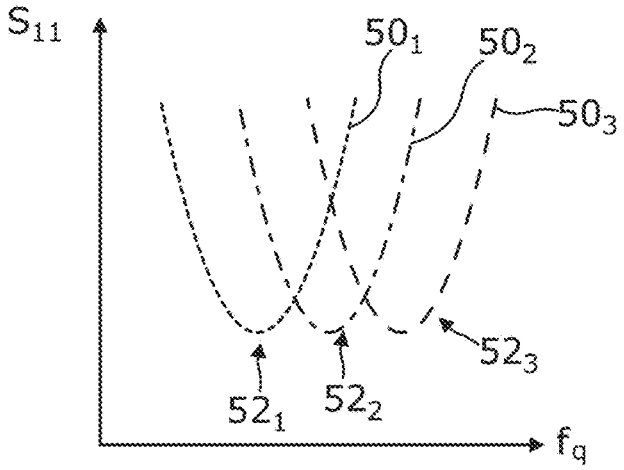
FIGS. 2A, 2B, 2C show an example of the subject-matter described herein.

FIG. 2A schematically illustrates a frequency response 50 of the reflection parameter $S_{11}$ for each of the multiple overlapping resonant modes 52. In this example, the conductive radiating element 20 is configured to have multiple overlapping resonant modes $\mathbf{52}_1$, $\mathbf{52}_2$, $\mathbf{52}_3$.

Each of the resonant modes $\mathbf{52}_1$, $\mathbf{52}_2$, $\mathbf{52}_3$ of the conductive radiating element 20 has an associated operational frequency band. The associated operational frequency bands of the multiple resonant modes 52 overlap.

Figure 2B:
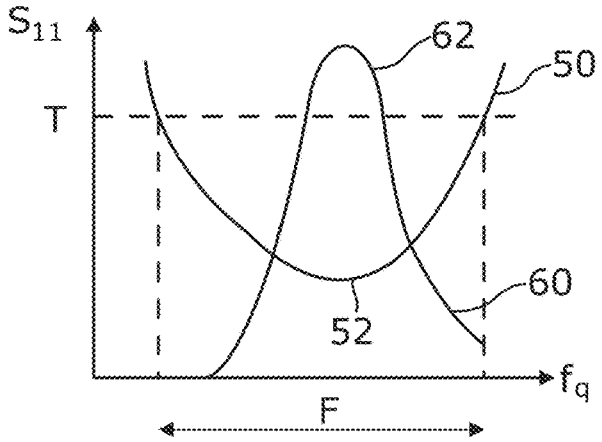
Figure 2C:
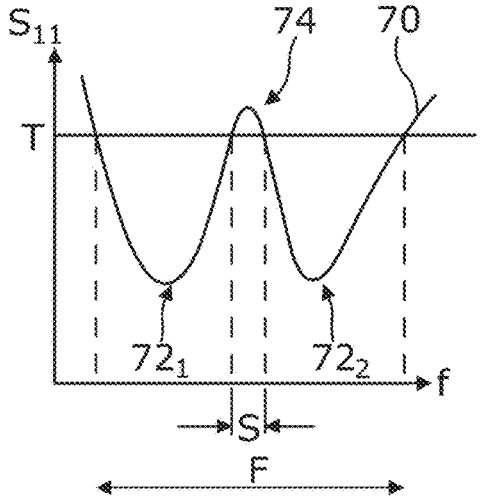

The overlap is sufficient to define a combined operational frequency band, as illustrated in FIG. 2B, that has a bandwidth equal to the first frequency range F.

As illustrated in FIG. 2B, the conductive resonator 30 is configured to have a frequency response 62 that provides a stop band S within the first frequency range F.

FIG. 2C illustrates a frequency response 70 of the reflection parameter $S_{11}$ for the combination of the conductive radiating element 20 and the conductive resonator 30 in the multi-layer antenna arrangement 10.

The frequency response 70 has a first operational band $\mathbf{72}_1$ and a second operational band $\mathbf{72}_2$ that are isolated by a stop band S. The reflection parameter $S_{11}$ is less than a threshold value T in the first operational band $\mathbf{72}_1$ and the second operational band $\mathbf{72}_2$ and is more than a threshold value T in the stop band S. The stop band S splits the first frequency range F into two distinct operational frequency bands $\mathbf{72}_1$,$\mathbf{72}_2$. The stop band S reduces cross-talk (interference) between the operational frequency bands $\mathbf{72}_1$, $\mathbf{72}_2$.

Figure 3:
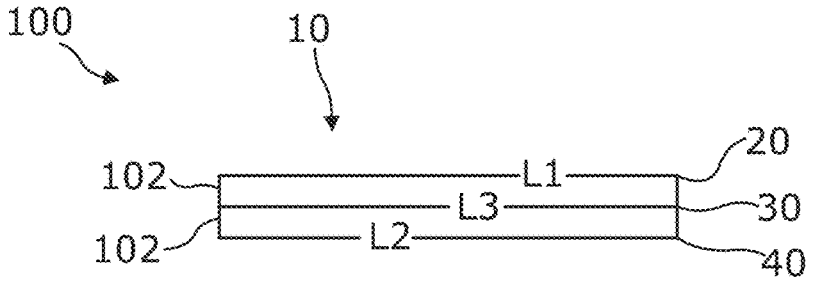
FIG. 3 shows an example of the subject-matter described herein.

As illustrated in FIG. 3, in some, but not necessarily all examples, the multi-layer antenna arrangement 10 is a single integrated component 100. The first layer L1 comprising the conductive radiating element 20, the second layer L2 comprising at least a portion of the ground plane 40 and the third layer L3 comprising the conductive resonator 30 are each integrated within the single component 100. In this example, dielectric material 102 interconnects the first layer L1 and the third layer L3 and dielectric material 102 interconnects the third layer L3 and the second layer L2. The dielectric material may be any suitable dielectric material, in some but not necessarily all examples it can be a solid dielectric material. The third layer L3 is embedded within the component 100.

The dielectric material 102 between the first layer L1 and the third layer L3 and/or the dielectric material 102 between the third layer L3 and the second layer L2 could be "mostly air" with physically small (relative to the area between L1/L3 or L2/L3) pillars between each layer used for mechanical support. Such supports will have a much smaller effect on the dielectric constant.

One or more of the layers L1, L2 could be supported by a dielectric layer below L2 or above L1 leaving mostly air between L1 & L3 and/or between L3 & L2. In this case small pillars could be used again to support L3 relative to either L1 and/or L2.

Figure 4:
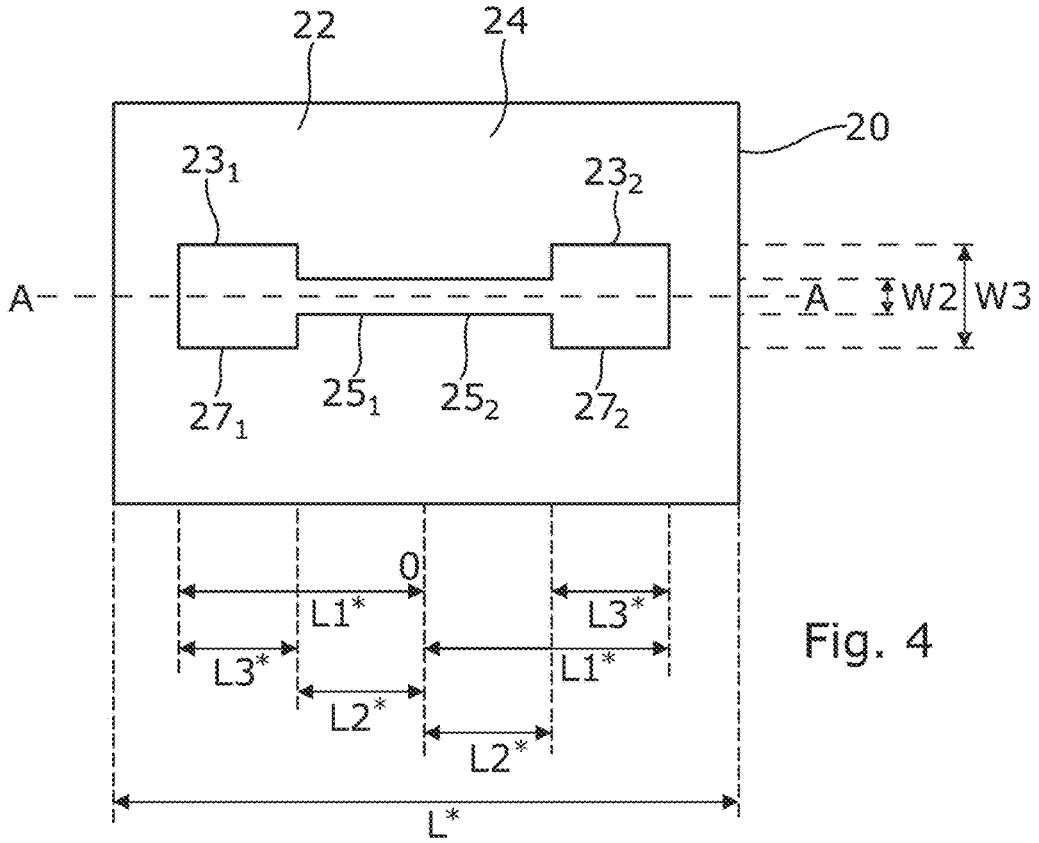
FIG. 4 shows an example of the subject-matter described herein.

FIG. 4 illustrates an example of a first layer L1 of the multi-layer antenna arrangement 10. The first layer L1 comprises the conductive radiating element 20. The conductive radiating element 20 is configured to have multiple overlapping resonant modes 52 that define a first frequency range F.

In this example, but not necessarily all examples, the conductive radiating element 20 is a slotted patch antenna 22. A slotted patch antenna 22 is a patch 24 that comprises slots 23. The patch 24 is formed from a continuous portion of conductive material and is typically a planar two-dimensional conductive sheet. The slots 23 are areas within the patch 24 where the conductive material has been removed or is not present.

A fundamental dipole mode of the slotted patch antenna 22 is responsible for a first resonance mode $\mathbf{52}_1$ and two slot modes are responsible for a second resonance mode $\mathbf{52}_2$ and a third resonance mode $\mathbf{52}_3$. A length L* of the conductive radiating element 20 determines the fundamental dipole mode. The resonant wavelength for a fundamental dipole mode is twice the electrical length equivalent to the physical length L*.

In this example, but not necessarily all examples, the conductive radiating element 20 comprises stepped straight slots 23. Each stepped straight slot 23 comprises a thinner straight central section 25 and a step to a wider straight peripheral section 27.

In the example illustrated, a first slot $\mathbf{23}_1$ and a second slot $\mathbf{23}_2$ are joined. The first slot $\mathbf{23}_1$ and the second slot $\mathbf{23}_2$ both extend along an axis of symmetry AA of the slotted patch antenna 22. The slotted patch antenna 22 has reflection symmetry in the line AA, in this example.

The first slot $\mathbf{23}_1$ comprises a thinner straight central section $\mathbf{25}_1$ and a wider straight peripheral section $\mathbf{27}_1$. Both the thinner straight central section $\mathbf{25}_1$ and the wider straight peripheral section $\mathbf{27}_1$ have reflection symmetry in the line AA. The total length of the first slot $\mathbf{23}_1$ is L1*. The thinner straight central section $\mathbf{25}_1$ has a length L2* and a width W2. The wider peripheral section $\mathbf{27}_1$ has a length L3*=L1*−L2* and a width W3.

The second slot $\mathbf{23}_2$ comprises a thinner straight central section $\mathbf{25}_2$ and a wider straight peripheral section $\mathbf{27}_2$. Both the thinner straight central section $\mathbf{25}_2$ and the wider strip peripheral section $\mathbf{27}_2$ have reflection symmetry in the line AA. The thinner straight central section $\mathbf{25}_2$ of the second slot $\mathbf{23}_2$ is interconnected to the thinner straight central section $\mathbf{25}_1$ of the first slot $\mathbf{23}_1$. The second slot $\mathbf{23}_2$ has a total length L1*. The thinner straight central section $\mathbf{25}_2$ has a length L2* and a width W2. The wider peripheral section $\mathbf{27}_2$ has a length L3*=L1*−L2* and a width W3.

The total length L1* of each slot 23 determines a second one $\mathbf{52}_2$ of the multiple resonant modes 52. The resonant wavelength for the second resonant mode $\mathbf{52}_2$ is twice the electrical length equivalent to the physical length L1*.

The dimensions, for example the length L3* and width W3 of the wider straight peripheral section 27, determine a third one $\mathbf{52}_3$ of the multiple resonant modes 52.

Figure 5:
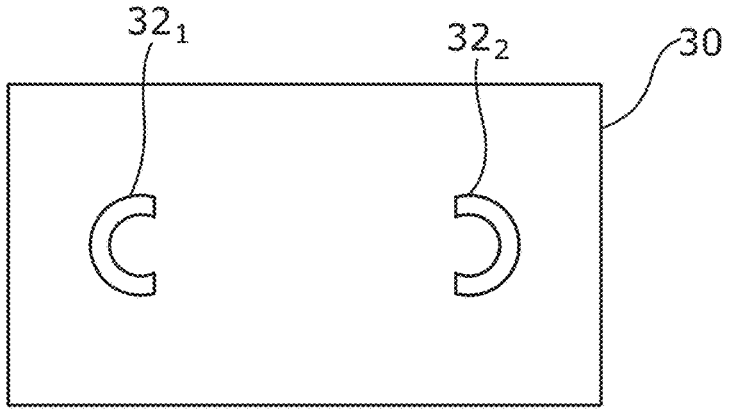
FIG. 5 shows an example of the subject-matter described herein.

FIG. 5 illustrates an example of the conductive resonator 30 in the third layer L3. The conductive resonator 30 is configured to provide a stop band S within the first frequency range F. The conductive resonator 30 in the third layer L3 can be a conductive element 32 within a dielectric (or a dielectric slot in a conductive element, according to Babinet's principle). The conductive resonator 30 in the third layer L3 can be a planar, two-dimensional conductive resonator 30.

In the example illustrated, but not necessarily all examples, the conductive element 32 is configured to operate as a reflector for the stop band frequencies S.

In this example, but not necessarily all examples, the conductive resonator 30 comprises multiple micro strip resonators $\mathbf{32}_n$ placed under respective slots $\mathbf{27}_n$ of the conductive radiating element 20. Each resonator $\mathbf{32}_n$ can be placed under any part of the respective slot $\mathbf{27}_n$, for example, each resonator $\mathbf{32}_n$ can be placed under a widest portion of the respective slot $\mathbf{27}_n$.

In this example, but not necessarily all examples, the micro strip resonators 32 are elongate, that is narrower than they are long, and curved, that is not-straight.

Figure 6:
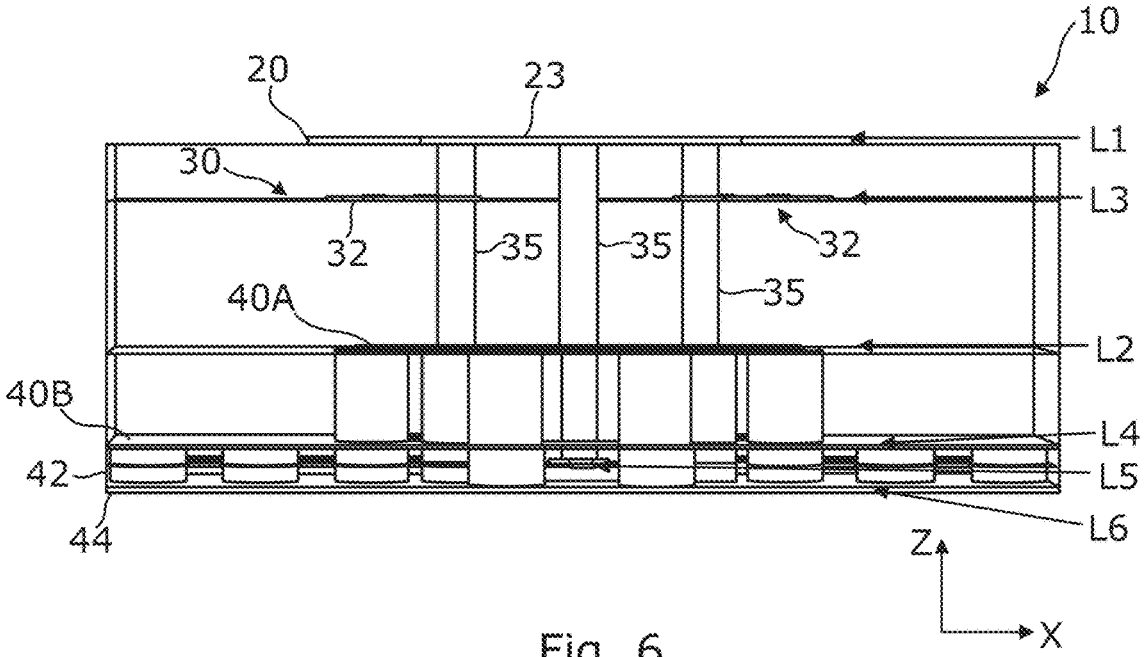
FIG. 6 and FIGS. 7A to 7D show an example of the subject-matter described herein.

FIG. 6 illustrates another example of a multi-layer antenna arrangement 10. The previous description of multi-layer antenna arrangement 10 and components of such an arrangement 10 is also relevant to this example.

The multi-layer antenna arrangement 10 comprises a first layer L1 comprising a conductive radiating element 20 configured to have multiple overlapping resonant modes 52

Figure 8A:
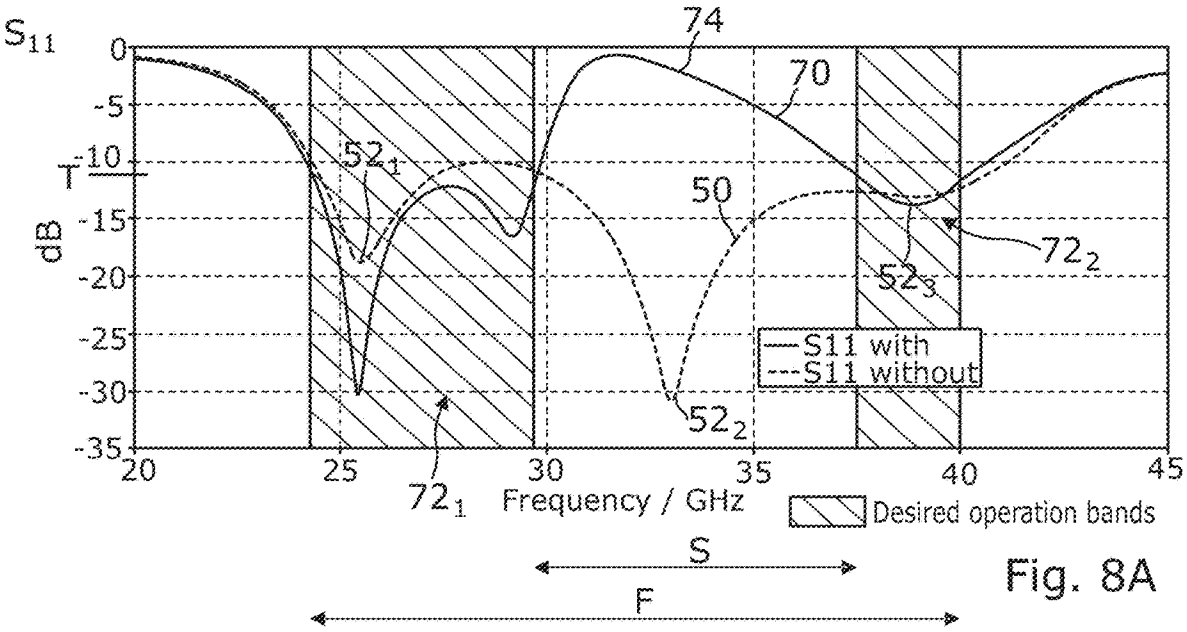
FIGS. 8A and 8B show an example of the subject-matter described herein.

(see FIG. 8A) that define a first frequency range F; a second layer L2 comprising at least a portion of a ground plane 40 for the conductive radiating element 20; and a third layer L3, between the first layer L1 and the second layer L2, comprising a conductive resonator 30 configured to provide a stop band S within the first frequency range F (see FIG. 8A).

In this example, the ground plane 40 comprises two parts 40A, 40B. The second layer L2 comprises a lifted ground plane 40A to enhance the gain in higher frequency bands and the multi-layer antenna arrangement 10 further comprises a fourth layer L4, below the second layer L2, comprising a main ground plane 40B for the conductive radiating element 20. The ground plane 40 for the conductive radiating element 20 is therefore a split ground plane comprising non-overlapping portions 40A, 40B. The portion 40A directly under the conductive radiating element 20 is lifted so that the gap between the conductive radiating element 20 and the ground plane 40 is less directly under the conductive radiating element 20 than outside the perimeter of the conductive radiating element 20.

The multi-layer antenna arrangement 10 additionally comprises a fifth layer L5 comprising a feed lines 42 and a sixth layer L6 comprising a ground 44 for the feed lines 42. The fourth layer L4 is directly under but separated from the second layer L2 and the fifth layer L5 is between and separated from the fourth layer L4 and the sixth layer L6.

Figure 7A:
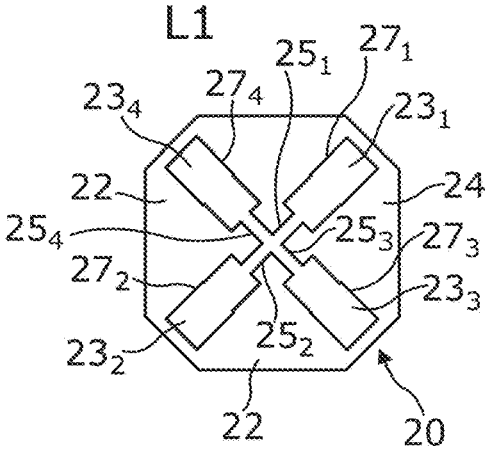

FIGS. 7A, 7B, 7C and 7D illustrate examples of the first layer L1, the third layer L3, the second layer L2 and the fifth layer L5 respectively. Referring to FIG. 7A, the conductive radiating element 20 is a planar slotted patch antenna 22. The conductive radiating element 20 comprises a symmetrical crossed-slot arrangement within the conductive radiating element 20. The symmetrical crossed-slot arrangement is comprised of two stepped straight slots 23 as described in relation to FIG. 4 that are orthogonal to each other and overlap.

The crossed-slot arrangement comprises a first slot $\mathbf{23}_1$, a second slot $\mathbf{23}_2$, a third slot $\mathbf{23}_3$ and a fourth slot $\mathbf{23}_4$. The first slot $\mathbf{23}_1$ and the second slot $\mathbf{23}_2$ are aligned along a first line. The third slot $\mathbf{23}_3$ and the fourth slot $\mathbf{23}_4$ are aligned along a second line, that is orthogonal to the first line. The crossed-slot arrangement enables two orthogonal polarizations for the multi-layer antenna arrangement 10.

Each stepped straight slot 23 comprises a thinner straight central section 25 and a step to a wider straight peripheral section 27.

In the example illustrated, a first slot $\mathbf{23}_1$, a second slot $\mathbf{23}_2$, a third slot $\mathbf{23}_3$ and a fourth slot $\mathbf{23}_4$ are joined to form a cross. The first slot $\mathbf{23}_1$ and the second slot $\mathbf{23}_2$ both extend along the first direction which is an axis of symmetry of the slotted patch antenna 22. The slotted patch antenna 22 has reflection symmetry in the first direction, in this example. The third slot $\mathbf{23}_3$ and the fourth slot $\mathbf{23}_4$ both extend along the second direction which is another axis of symmetry of the slotted patch antenna 22. The slotted patch antenna 22 has reflection symmetry in the second direction, in this example. The second direction is orthogonal to the first direction.

The first slot $\mathbf{23}_1$ comprises a thinner straight central section $\mathbf{25}_1$ and a wider straight peripheral section $\mathbf{27}_1$. Both the thinner straight central section $\mathbf{25}_1$ and the wider straight peripheral section $\mathbf{27}_2$ have reflection symmetry in the first line. The total length of the first slot $\mathbf{23}_1$ is L1*. The thinner straight central section $\mathbf{25}_1$ has a length L2* and a width W2. The wider peripheral section $\mathbf{27}_1$ has a length L3*=L1*−L2* and a width W3.

The second slot $\mathbf{23}_2$ comprises a thinner straight central section $\mathbf{25}_2$ and a wider straight peripheral section $\mathbf{27}_2$. Both the thinner straight central section $\mathbf{25}_2$ and the wider strip peripheral section $\mathbf{27}_2$ have reflection symmetry in the first line. The thinner straight central section $\mathbf{25}_2$ of the second slot $\mathbf{23}_2$ is interconnected to the thinner straight central section $\mathbf{25}_1$ of the first slot $\mathbf{23}_1$. The second slot $\mathbf{23}_2$ has a total length L1*. The thinner straight central section $\mathbf{25}_2$ has a length L2* and a width W2. The wider peripheral section $\mathbf{27}_2$ has a length L3*=L1*−L2* and a width W3.

The third slot $\mathbf{23}_3$ comprises a thinner straight central section $\mathbf{25}_3$ and a wider straight peripheral section $\mathbf{27}_3$. Both the thinner straight central section $\mathbf{25}_3$ and the wider straight peripheral section $\mathbf{27}_3$ have reflection symmetry in the second line. The total length of the third slot $\mathbf{23}_3$ is L1*. The thinner straight central section $\mathbf{25}_3$ has a length L2* and a width W2. The wider peripheral section 27 has a length L3*=L1*−L2* and a width W3.

The fourth slot $\mathbf{23}_4$ comprises a thinner straight central section $\mathbf{25}_4$ and a wider straight peripheral section $\mathbf{27}_4$. Both the thinner straight central section $\mathbf{25}_4$ and the wider strip peripheral section $\mathbf{27}_4$ have reflection symmetry in the second line. The thinner straight central section $\mathbf{25}_4$ of the fourth slot $\mathbf{23}_4$ is interconnected to the thinner straight central section $\mathbf{25}_4$ of the third slot $\mathbf{23}_3$. The fourth slot $\mathbf{23}_4$ has a total length L1*. The thinner straight central section $\mathbf{25}_4$ has a length L2* and a width W2. The wider peripheral section $\mathbf{27}_4$ has a length L3*=L1*−L2* and a width W3.

The planar conductive radiating element 20 has 90° rotational symmetry within the plane of the first layer L1.

The conductive radiating element 20 is a slotted patch antenna 22 that has directional gain. The conductive radiating element 20 is planar.

The patch 24 of the planar conductive radiating element 20 is fed via feed lines 35. The feed lines 35 are vertically arranged and extend through the second layer L2 and the third layer L3 and to contact the patch 24 of the planar conductive radiating element 20. The lifted ground portion 40A in the second layer L2 comprises apertures 41 through which the vertical feed lines 35 extend (see FIG. 7C). In this example, the vertical feed lines 35 make galvanic contact with the patch 24 of the planar conductive radiating element 20.

Figure 7B:
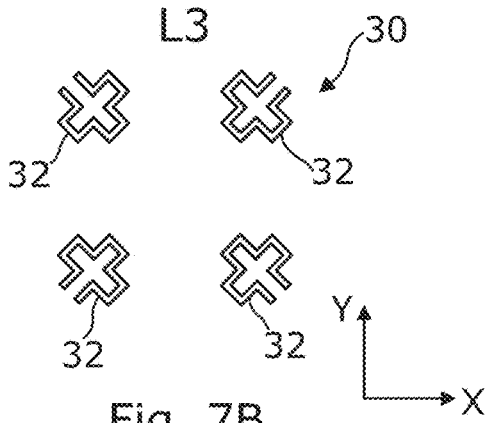

The conductive resonator 30 in the third layer L3, is illustrated in FIG. 7B. In this example, the conductive resonator 30 comprises multiple elongate conductive elements 32 each of which is a microstrip resonator. Each microstrip resonator $\mathbf{32}_n$ is placed under a respective slot $\mathbf{27}_n$ of the planar conductive radiating element 20. The microstrip resonators 32 are curved in that they are not a straight line. They have a cruciform form. Each elongate conductive element 32 traces a substantial portion of a perimeter of a cross. The shape could also be described as a meandering form, series-connected C-shaped or U-shaped conductive portions.

The conductive resonator 30, in the third layer L3, is configured to operate as a reflector for stop band frequencies S. The resonator 30 represents an impedance discontinuity/mismatch for propagating currents at the stop band frequency. The propagating current is reflected back from the location of the resonator 30 in the arrangement 10. This can be considered to be an impedance mismatch at the antenna input port.

The conductive resonator 30 operates as a band stop filter integrated within the arrangement 10. The total length of the resonator 30 determines the center frequency of the band notch filter. The width of the resonator 30, the distance between the patch 22 and the resonator 30 and the location of the resonator 30 under the slot 23 (along the slot end) together define a width of the stop band S.

Figure 7C:
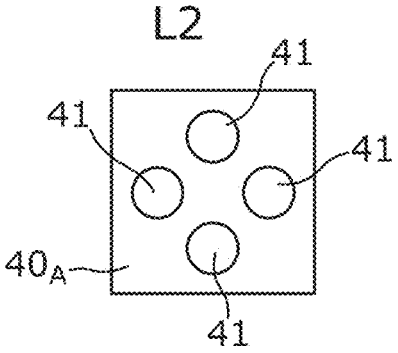

FIG. 7C illustrates an example of a lifted ground plane 40A in the second layer L2. The lifted ground plane 40A is configured to enhance the gain in higher frequency bands. The lifted ground plane enhances the gain in the higher frequencies so that the gain over both of the operational frequency bands $\mathbf{72}_1$, $\mathbf{72}_2$ will be flat (see FIG. 8B).

Figure 7D:
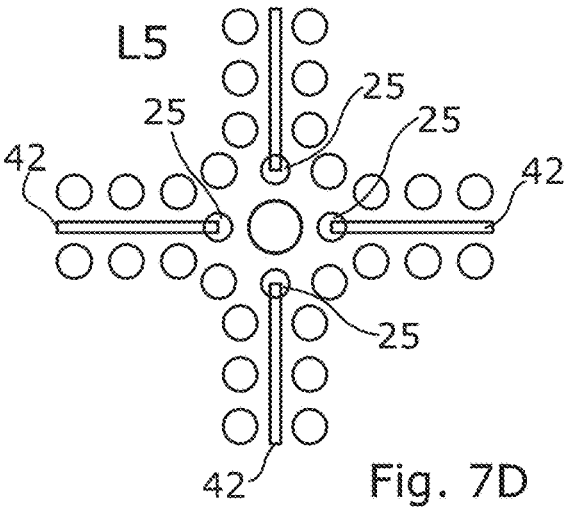

FIG. 7D illustrates an example of feed lines 42 which are mounted over a ground 44 for the feed lines 42. The illustrated horizontal feed lines 42 interconnect with the vertically extending feed lines 35 also illustrated in the FIG. 7D. The feed lines 42/35 are used to differentially feed the slotted patch antenna 22. A differential feed arrangement is one in which a structure is excited by two signals which have the same amplitude but a 180° difference in phase. Thus, the feed signal is fed to a position intermediate of the first slot $\mathbf{23}_1$ and the third slot $\mathbf{23}_3$ is 180° out of phase with the signal fed to a position intermediate of the second slot $\mathbf{23}_2$ and the fourth slot $\mathbf{23}_4$. Likewise, a signal that is fed to a position intermediate of the first slot $\mathbf{23}_1$ and the fourth slot $\mathbf{23}_4$ is 180° out of phase with the signal fed to the position intermediate of the second slot $\mathbf{23}_2$ and the third slot $\mathbf{23}_3$.

The multi-layer antenna arrangement 10 may be formed as a single component in which the multiple layers L1 to L6 are integrated within the single component. In some, but not necessarily all examples, the different layers may be separated using dielectric material.

FIG. 8A schematically illustrates a frequency response 50 of the reflection parameter $S_{11}$ associated with the conductive radiating element 20 (without the conductive resonator 30) and a frequency response 70 of the reflection parameter $S_{11}$ associated with the conductive radiating element 20 (with the conductive resonator 30). The frequency response 70 of the reflection parameter $S_{11}$ is the frequency response of the multi-layer antenna arrangement 10.

The conductive radiating element 20 is configured to have multiple overlapping resonant modes $\mathbf{52}_1$, $\mathbf{52}_2$, $\mathbf{52}_3$. Each of the resonant modes $\mathbf{52}_1$, $\mathbf{52}_2$ $\mathbf{52}_3$ of the conductive radiating element 20 has an associated operational frequency band. The associated operational frequency bands of the multiple resonant modes 52 overlap and the overlap is sufficient to define a combined operational frequency band, as illustrated in FIG. 8A, that has a bandwidth equal to the first frequency range F.

The conductive resonator 30 is configured to have a frequency response that provides a stop band S within the first frequency range F.

The frequency response 70 has a first operational band $\mathbf{72}_1$ and a second operational band $\mathbf{72}_2$ that are isolated by the stop band S. The reflection parameter $S_{11}$ is less than a threshold value T in the first operational band $\mathbf{72}_1$ and the second operational band $\mathbf{72}_2$ and is more than a threshold value T in the stop band S. The stop band S splits the first frequency range F into two distinct operational frequency bands $\mathbf{72}_1$,$\mathbf{72}_2$. The stop band S reduces cross-talk (interference) between the operational frequency bands $\mathbf{72}_1$, $\mathbf{72}_2$.

As previously described, the first layer L1 comprising a conductive radiating element 20 is configured to have multiple overlapping resonant modes 52 that define a first frequency range F. The third layer L3, between the first layer L1 and the second layer L2, comprises a conductive resonator 30 configured to provide a stop band S within the frequency range F.

Figure 8B:
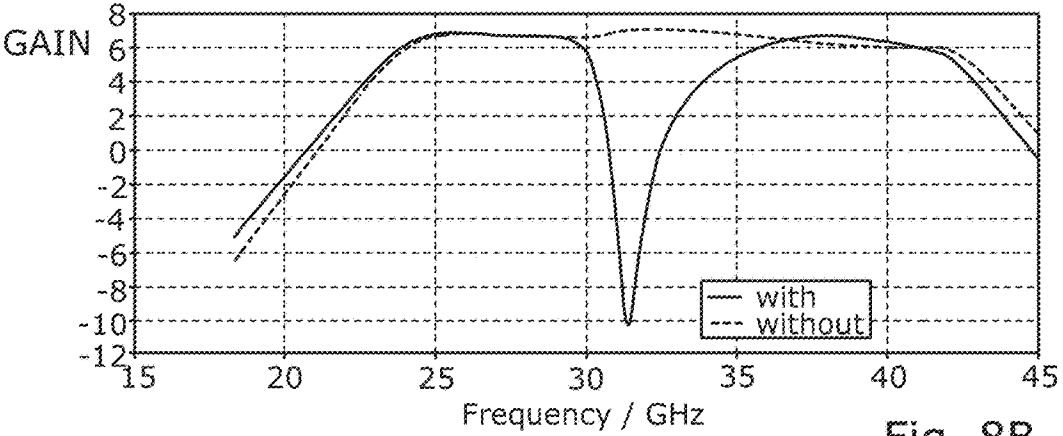

The frequency selective attenuation provided by the conductive resonator 30 in the third layer L3 can be observed from FIG. 8B.

Figure 9A:
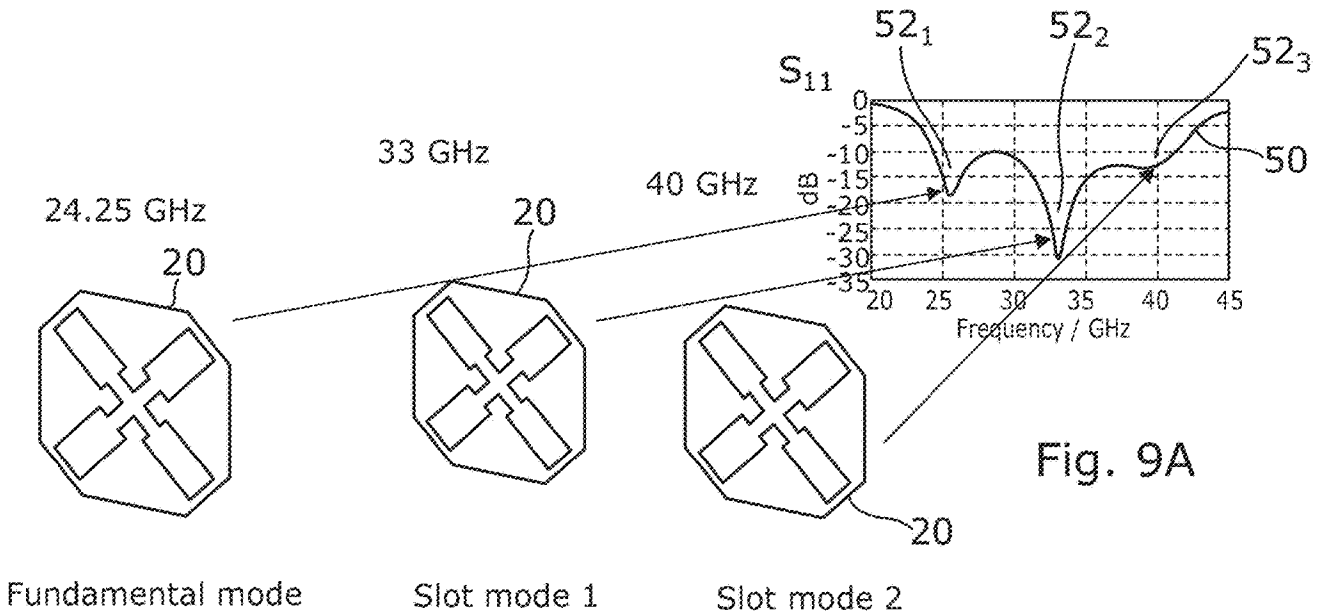
FIGS. 9A and 9B show an example of the subject-matter described herein.
Figure 9B:
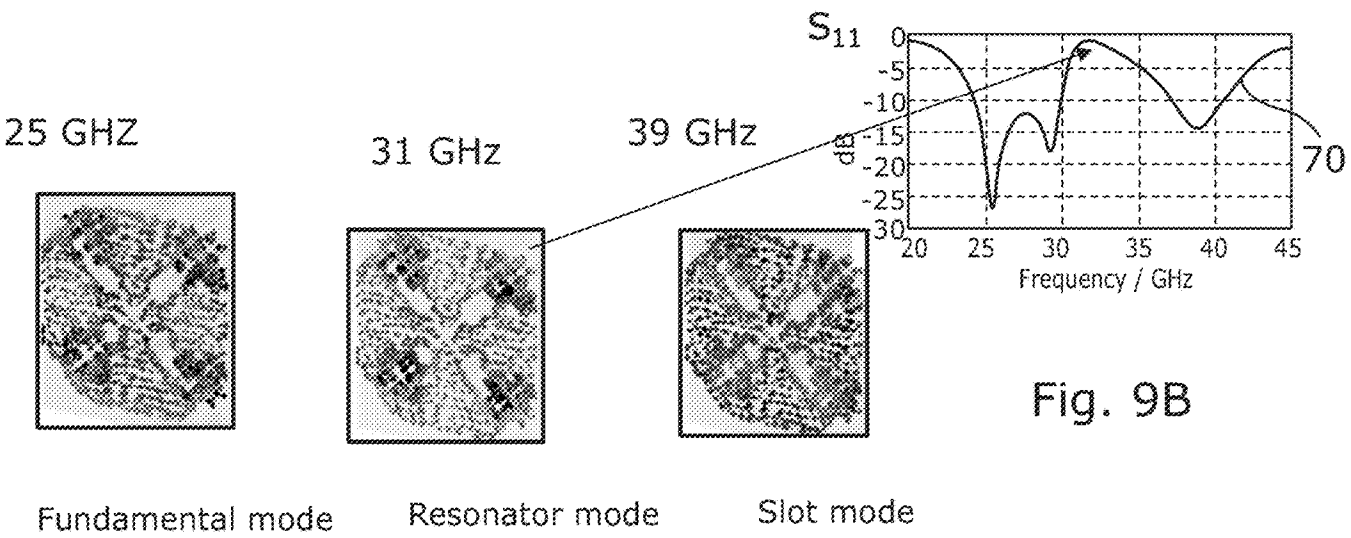

FIG. 9A schematically illustrates a frequency response 50 of the reflection parameter $S_{11}$ associated with the conductive radiating element 20 (without the conductive resonator 30) and FIG. 9B schematically illustrates a frequency response 70 of the reflection parameter $S_{11}$ associated with the conductive radiating element 20 (with the conductive resonator 30). The frequency response 70 of the reflection parameter $S_{11}$ is the frequency response of the multi-layer antenna arrangement 10.

As can be observed from FIG. 9A, a fundamental dipole mode of the slotted patch antenna 22 is responsible for a first resonance mode $\mathbf{52}_1$ and two slot modes are responsible for a second resonance mode $\mathbf{52}_2$ and a third resonance mode $\mathbf{52}_3$.

A length L* of the conductive radiating element 20 determines the fundamental dipole mode that provides the first resonance mode $\mathbf{52}_1$. The resonant wavelength for the first resonant mode $\mathbf{52}_1$ is twice the electrical length equivalent to the physical length L*.

A width and length of the stepped slots 23 determine the second resonant mode $\mathbf{52}_2$ and the third resonant mode $\mathbf{52}_3$.

The total length L1* of each slot 23 determines a second one $\mathbf{52}_2$ of the multiple resonant modes 52. The resonant wavelength for the second resonant mode $\mathbf{52}_2$ is twice the electrical length equivalent to the physical length L1*.

The dimensions L3*, W3 of the wider strip peripheral section 27 of the slot 23 determine a third one $\mathbf{52}_3$ of the multiple resonant modes 52. The wider strip peripheral section 27 operates as a $\lambda/4$ resonator. The resonant wavelength for the second resonant mode $\mathbf{52}_1$ is four times the electrical length equivalent to the physical length L3*.

In this example, the first frequency range F is greater than 24 GHz. For example, the first frequency range can be within 24 to 86 GHz.

In FIG. 9B, if the operational bandwidth is defined by a threshold −10 dB for the reflection parameter $S_{11}$, the first operational band $\mathbf{72}_1$ is 24.25 to 29.5 GHz and the second operational band $\mathbf{72}_2$ is 37 to 40 GHz.

Figure 10:
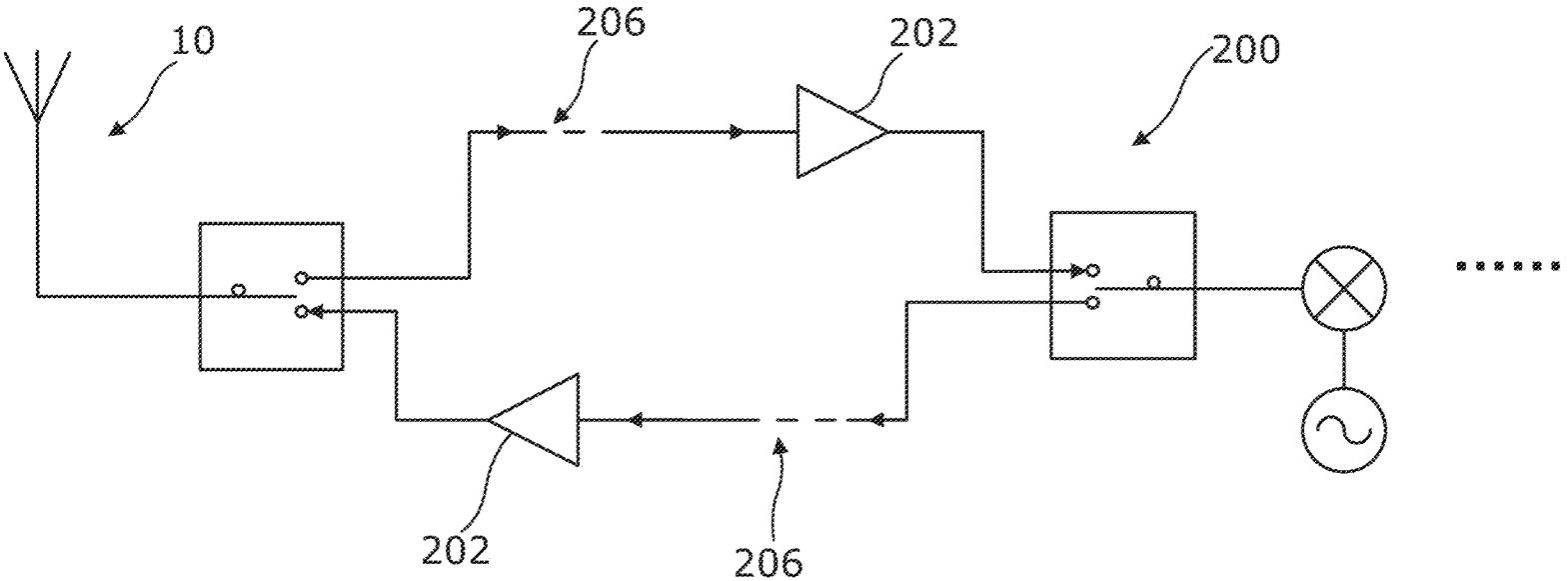
FIG. 10 shows an example of the subject-matter described herein.

FIG. 10 illustrates an example of a transceiver system 200 comprising the multi-layer antenna arrangement 10. The transceiver system comprises a receiver system and a transmitter system. In this example, the multi-layer antenna arrangement 10 is directly connected to amplification circuitry 202 without an intervening band stop filter component. The absence of the band stop filter component is indicated by reference 206 in the receiver system and the transmitter system.

The transceiver system 200 may be used in a base station or a mobile station. It may, for example, be suitable for use in 5G telecommunications.

In a receiver only implementation, the receiver system is present but the transmitter system is not. In a transmitter only implementation, the transmitter system is present but the receiver system is not.

The transceiver system 200 and/or the multi-layer antenna arrangement 10 have several advantages including compact size, good inter-band rejection, a constant radiation pattern shape for dual band and dual polarization, flat gain performance over desired operation bands, ease of fabrication and freedom of resonator design by adjusting the geometry of four individual resonators 32.

In each of the preceding examples, the first slot $\mathbf{23}_1$ and the second slot $\mathbf{23}_2$ or the first slot $\mathbf{23}_1$, the second slot $\mathbf{23}_2$, the third slot $\mathbf{23}_3$ and the fourth slot $\mathbf{23}_4$ can each comprise a thinner straight central section $\mathbf{25}_1$, a wider straight intermediate section and an even wider straight peripheral section $\mathbf{27}_1$. The thinner straight central section $\mathbf{25}_1$, the wider straight intermediate section and the even wider straight peripheral section have reflection symmetry in the first line. The total length of the first slot $\mathbf{23}_1$ is L1*. The thinner straight central section $\mathbf{25}_1$ has a length L2* and a width W2.

In each of the preceding examples, additional conductive layers may be present forming a stacked patch configuration.

Where a structural feature has been described, it may be replaced by means for performing one or more of the functions of the structural feature whether that function or those functions are explicitly or implicitly described.

An operational resonant mode (operational band or bandwidth) is a frequency range over which an antenna can efficiently operate. An operational resonant mode (operational band) may be defined as where the absolute value of the return loss S11 of the antenna arrangement is greater than an operational threshold T.

The antenna arrangement 10 may be configured to operate in a plurality of operational resonant frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz); 5G communications (not yet finalized but may include e.g. 700 MHz, 3.6-3.8 GHz, 24.25-27.5 GHz, 31.8-33.4 GHz, 37.45-43.5, 66-71 GHz, mmWave, and >24 GHz).

As used here 'module' refers to a unit or apparatus that excludes certain parts/components that would be added by an end manufacturer or a user. The antenna arrangement 10 can be a module.

The above described examples find application as enabling components of: automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

That which is claimed is:

1. A multi-layer antenna arrangement comprising:

a first layer comprising a conductive radiating element configured to have multiple overlapping resonant modes that define a first frequency range;

a second layer comprising at least a portion of a ground plane for the conductive radiating element; and a third layer, between the first layer and the second layer, comprising a conductive resonator configured to provide a stop band within the first frequency range.

2. A multi-layer antenna arrangement as claimed in claim 1, wherein the first, second and third layers are integrated as a single component.

3. A multi-layer antenna arrangement as claimed in claim 1, wherein the first frequency range is greater than 24 GHz.

4. A multi-layer antenna arrangement as claimed in claim 1, wherein the conductive radiating element is a slotted patch antenna.

5. A multi-layer antenna arrangement as claimed in claim 4, wherein a fundamental dipole mode of the slotted patch antenna is responsible for a first resonance mode and two slot modes are responsible for a second and a third resonance mode, and wherein a length of the conductive radiating element determines the fundamental dipole mode.

6. A multi-layer antenna arrangement as claimed in claim 4, wherein the conductive radiating element comprises stepped straight slots, each slot comprising a thinner straight central section and a wider straight peripheral section.

7. A multi-layer antenna arrangement as claimed in claim 6, wherein a total length of each slot determines a second one of the multiple resonant modes.

8. A multi-layer antenna arrangement as claimed in claim 6, wherein dimensions of the wider straight peripheral portion determine a third one of the multiple resonant modes.

9. A multi-layer antenna arrangement as claimed in claim 1, wherein the resonator, in the third layer, is configured to operate as a reflector for stop band frequencies.

10. A multi-layer antenna arrangement as claimed in claim 1, wherein the conductive resonator comprises multiple microstrip resonators, placed under respective slots of the conductive radiating element.

11. A multi-layer antenna arrangement as claimed in claim 10, wherein the microstrip resonators are curved.

12. A multi-layer antenna arrangement as claimed in claim 1, comprising a symmetrical crossed slot arrangement in the conductive radiating element.

13. A multi-layer antenna arrangement as claimed in claim 1, wherein the second layer is a lifted ground plane to enhance the gain in higher frequency bands and the multi-layer antenna arrangement further comprises a fourth layer, below the second layer comprising a main ground plane for the conductive radiating element.

14. A transceiver system comprising the multi-layer antenna arrangement as claimed in claim 1.

15. A transceiver system as claimed in claim 14, wherein the multi-layer antenna arrangement is directly connected to amplification circuitry without an intervening bandstop filter component.

16. A base station or a mobile station comprising the multi-layer antenna arrangement as claimed in claim 1.

* * * * *